United States Patent [19]

Garoffolo

[11] 4,437,573

[45] Mar. 20, 1984

[54] BOOM RACK FOR HANDLING AND POSITIONING CARGO TIE DOWN EQUIPMENT

[75] Inventor: Frank Garoffolo, Westport, Conn.

[73] Assignee: Aviatec, Inc., Westport, Conn.

[21] Appl. No.: 336,225

[22] Filed: Dec. 31, 1981

[51] Int. Cl.[3] ..... B66C 23/20

[52] U.S. Cl. ..... 212/263; 212/168; 254/389; 254/415

[58] Field of Search ..... 212/168, 241, 263; 254/389, 415, 394; 414/391, 399

[56] References Cited

U.S. PATENT DOCUMENTS

| | | | |
|---|---|---|---|
| 893,678 | 7/1908 | Van Wie | 254/394 |
| 2,377,758 | 6/1945 | Cohen | 212/263 |
| 2,833,423 | 5/1958 | Tucker | 254/394 |
| 3,171,633 | 3/1965 | Le Bus, Jr. et al. | 254/415 |

FOREIGN PATENT DOCUMENTS

| | | | |
|---|---|---|---|
| 6609663 | 1/1967 | Netherlands | 254/394 |

*Primary Examiner*—Galen L. Barefoot
*Assistant Examiner*—Rodney Corl
*Attorney, Agent, or Firm*—David H. Semmes; Warren E. Olsen

[57] ABSTRACT

A boom rack assembly pivotally mounted upon a wall or ceiling, warehouse stacker or the like, either a fixed or movable apparatus, for handling and positioning a cargo net or tie down over palletized cargo. The device includes a pair of vertically disposed, inverted J-shaped tubes complemented with rollers, pulleys or sprockets as an assembly, each having a counterweighted cable or chain extending therethrough with a hook harness hanging outwardly thereof. The tubes may be pivoted outwardly of the wall fixture such that the hooks may be pulled outwardly of the tubes and clasped to the cargo net or related tie down equipment. Upon release of the hooks, the counter-weights then lift the net, while the booms by retracting, vertically convey the net over the carbo, such that the net, when released from the device, may be secured conventionally at its edges to the cargo pallet.

11 Claims, 8 Drawing Figures

BOOM RACK FOR HANDLING AND POSITIONING CARGO TIE DOWN EQUIPMENT

BACKGROUND OF THE INVENTION

1. Field of the Invention

This invention relates to the cargo industry, particularly aircraft cargo wherein bulk cargo, including loose packages, is secured on pallets by means of cargo nets. The invention concerns an improvement in the present art of accomplishing the tedious task of manually lifting the cargo tie down equipment, such as nets, and spreading the webbing assembly over the contour of the packaged cargo, prior to fastening the webbing outer buckling to the pallet base.

An object of the invention is to simplify and enhance netting of a pallet by way of raising and pulling the cargo net over the loaded pallet without motorized assistance or complex mechanical apparatus.

The device has the advantageous feature of not requiring warehouse floor space either while in use or in the stored position. In fact, the bracket mounting is fitted upon a building or warehouse wall and, in most cases, may be secured to the uprights of a storage rack or pallet stacker. The pivoted support of the swing rig boom assembly upon a wall allows full utilization of the warehouse floor space and unobstructed transportation of containerized cargo under and around the installation, while the retracting boom is collapsed against the wall. The apparatus is easy to use, safe to operate and practically maintenance free.

The present art of netting a cargo pallet makes use of expensive motorized hoisting devices that engage a previously suspended cargo net around its large perimeter, lift the net and then lower the net in place over the cargo. Other methods include manually throwing or trawling the net over the palletized cargo from floor level or elevated side platforms or walkways.

Also, poles with end hooks and pawls for hoisting and pulling the cargo net are employed in warehousing operations with consequent waste of manpower and time.

The present invention is designed to meet all requirements of the competitive cargo industry, where costs of equipment and manpower are to be minimized and time of operations for aircraft "turn-around" are optimized by enhanced cargo loading and unloading.

2. Description of the Prior Art

Being submitted separately under the provisions of 37 C.F.R. 1.97.

SUMMARY OF THE INVENTION

According to the present invention, a pair of inverted J-shaped tubes are pivotally mounted in a wall bracket, such that the shank of the tube may be pivoted outwardly from the wall. A counter-weighted cable, cable rope, chain extends through each of the inverted J-shaped tubes, such that a cargo net hook is exposed outwardly thereof. As the operator desires to lift the cargo net, vinyl cloth, plastic line or the like over the palletized or loose cargo, the net hooks are pulled and extended and the inverted tubes are pivoted over the cargo so that the hooks may engage the cargo net. As the operator releases the hooks, the counter-weights lift the net over the cargo and the inverted J-shaped tubes are pivoted to return to their vertical position adjacent the wall bracket. Each inverted J-shaped tube may include a swivel in the bight portion, such that each of the tubes may be pivoted from side to side as a further lateral adjustment feature in positioning the cargo net. Also, idler rollers may be provided within the J-shaped tubes for guiding of the chain and an annular safety pad or ring may be secured around each of the hook assemblies.

DESCRIPTION OF THE PREFERRED EMBODIMENTS

Figure 1:
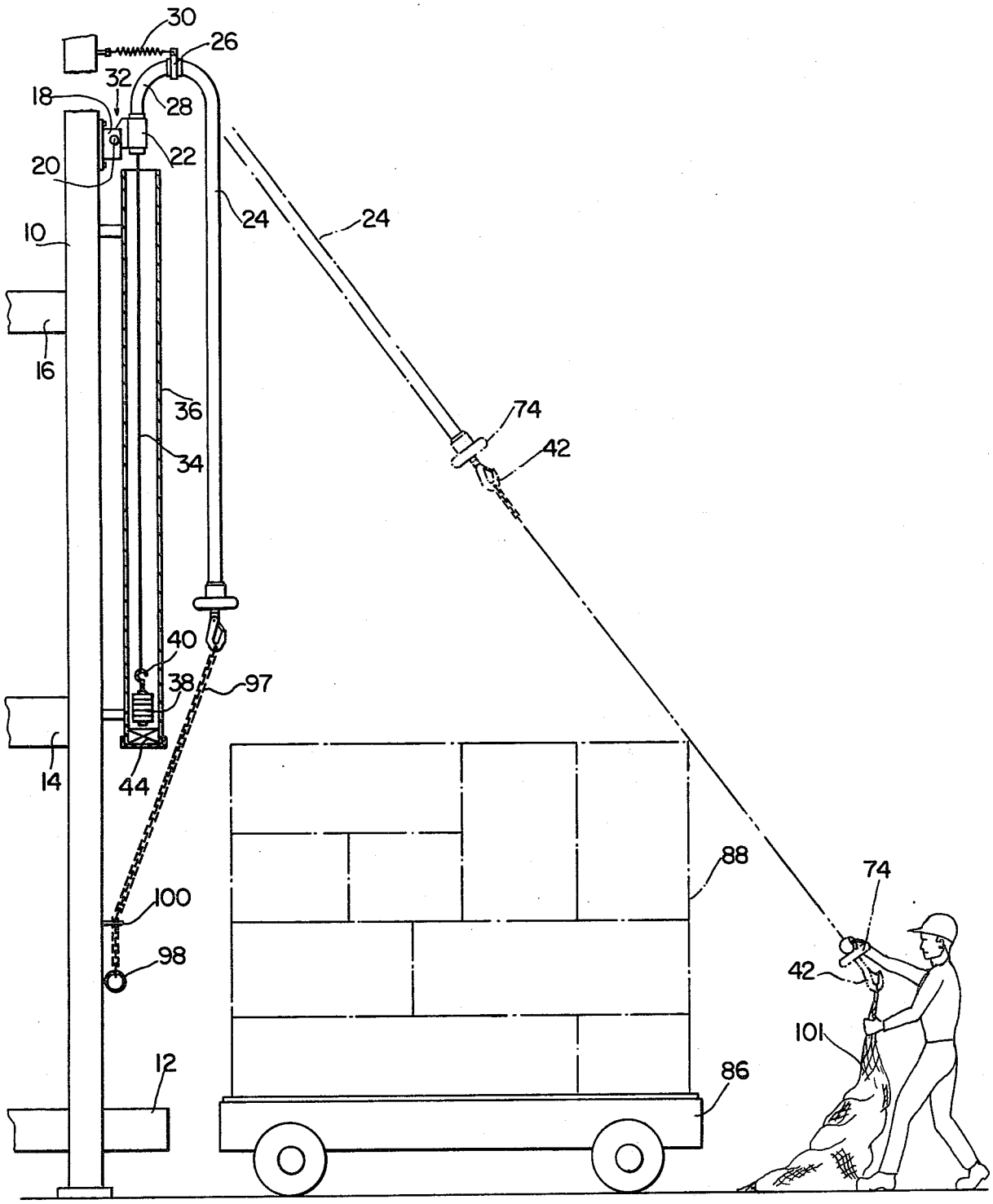
FIG. 1 is a vertical elevation, showing the wall mounted inverted J-shaped device adjacent a cargo pallet supported upon a dolly or lift and, in phantom, the outwardly pivoted portion of the tube as the operator engages the cargo net.

In FIG. 1 there is illustrated a typical warehouse stacker roller decking assembly 10, embodying a first level for pallet storage 12, a second level 14 and a third level 16.

A bifurcated wall bracket 18 may be mounted upon the stacker roller deck, so as to support a tube end coupling 22 in a pivot mode upon horizontal axis 20. An inverted J-shaped tube having sections 28 and 24 may be mounted with the J-end secured in tube coupling 22. The tube 24 may be articulated by means of a swivel 26 supported in the bight such that the tube shank 24 may be pivoted from side to side within swivel 26, as an assistance in laterally positioning the cargo net. A tension spring 30 may be mounted in wall bracket wall plate 32 and extend to swivel 26, so as to retain the tubing 24 in a substantially vertical mode, as it is released by the cargo operator. Alternatively, a torsion spring (not illustrated) may be fitted within the coupling 22 assembly.

The palletized cargo 88 may be supported upon dolly or lift 86. Conventionally, the palletized cargo is pushed or urged inwardly onto the stacker roller deck level from the dolly or lift, which is commonly used as a "build-up" station. In the "breakdown" mode, the palletized cargo is urged outwardly from the stacker deck onto the dolley. In the "build-up" mode cargo is secured by means of a cargo net or webbing which is lifted over the cargo (sometimes 10 feet or higher) and secured within the pallet sides, according to pertinent transportation regulations. In the "breakdown" mode the operation is reversed.

Figure 2:
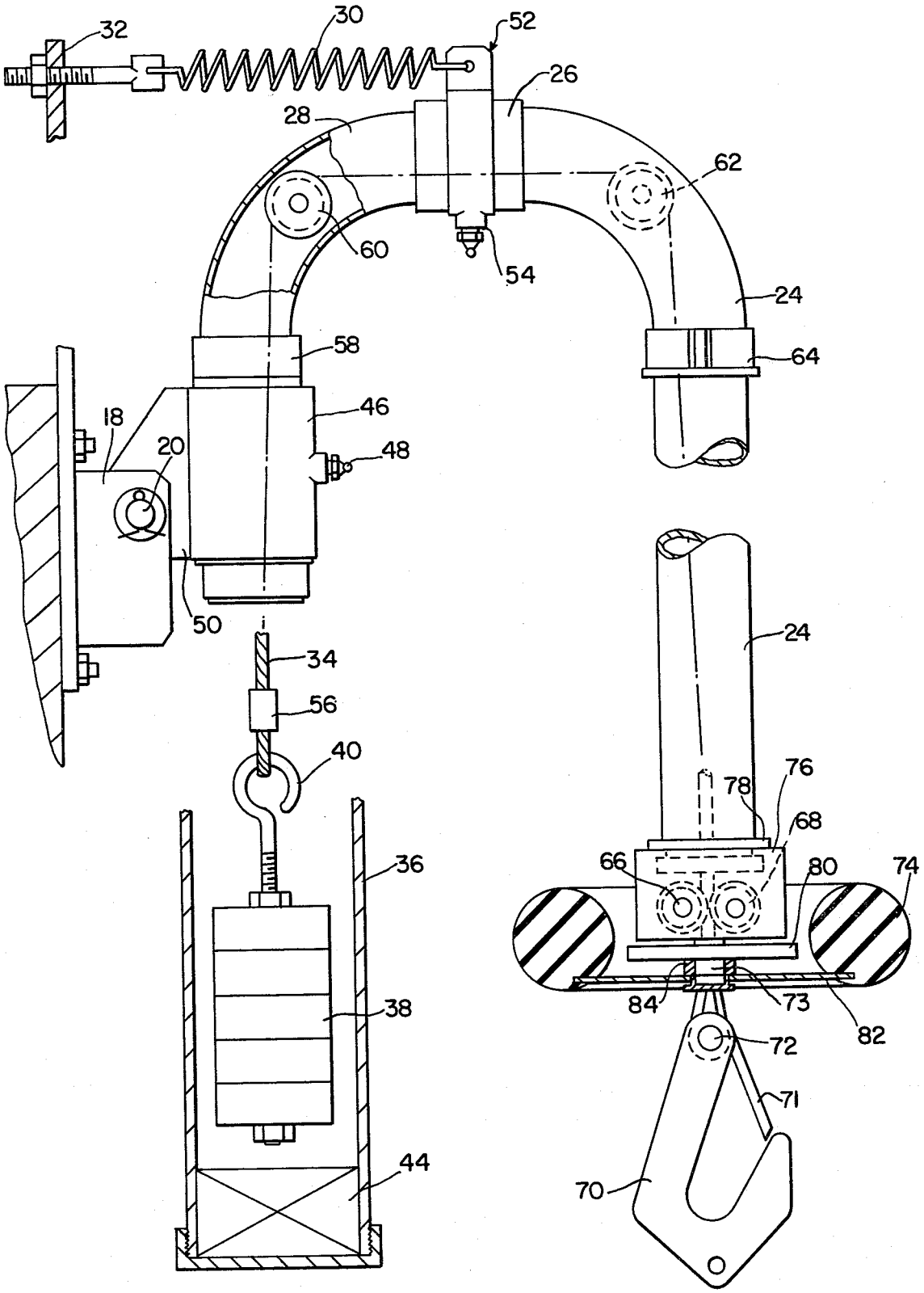
FIG. 2 is a fragmentary vertical elevation, partially in section, showing the pivoted bracket for the tube end, the bight portion swivel, as well as the tube end housing and annular protection pad adjacent the cargo hook.

In FIG. 2, the inverted J-shaped tubing section 28 is shown secured in coupling 46, having a flange 50 which extends inwardly intermediate bracket fins 18 for securement by horizontal pin 20. The tube end may be secured within reinforcing sleeve 58 prior to insertion within coupling 46. Also, a suitable lubricating nipple 48 may be employed. The cable or chain 34 is shown as secured to I-bolt 40 extending through counter-weights 38 with the free end of the cable being secured in a compress 56, or the like. Manifestly, any type of elongated elastic or wire line may be substituted for the cable or chain. A foam pad 44, or the like, may be positioned at the bottom of chain guard well 36. A pair of idler rollers or sprockets 60-62 may be positioned in the J-shaped bight, so as to rotatably engage the cable or chain 34 as it encircles pin 72 mounted within cargo net hook or similar grasping element 70. When cable 34 is not in use, a pull chain having pull ring 98 may be secured to hook 70 and the pull chain secured in bracket 100. Swivel 26 may include an outer collar supporting a lug 52 for mounting the tension spring 30 and a suitable lubricating nipple 54.

Figure 3:
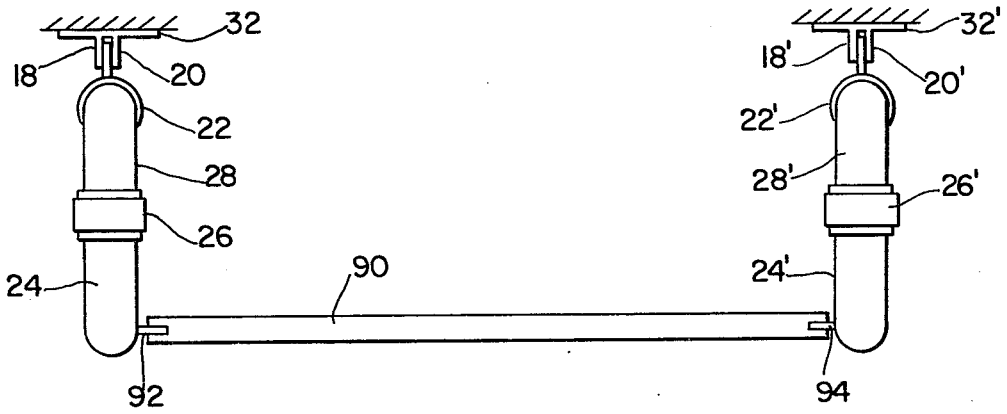
FIG. 3 is a top plan, showing a pair of swing rigs secured in tandem, one to the other by a transverse bar.
Figure 4:
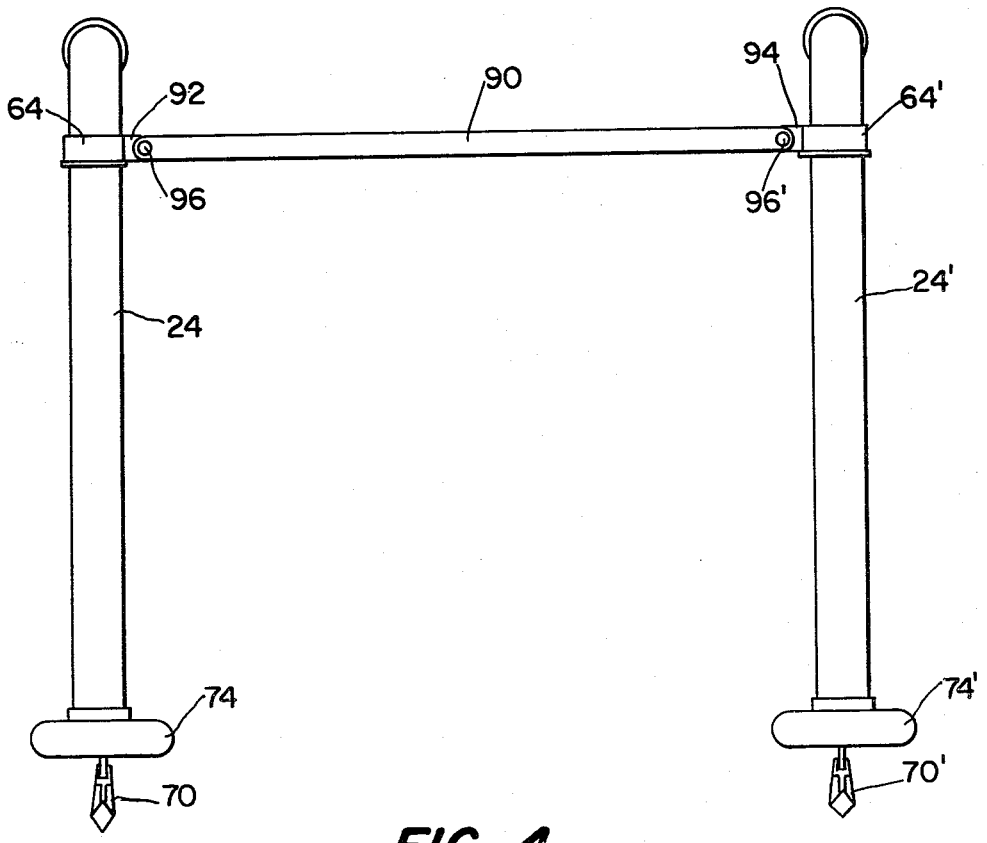
FIG. 4 is a front elevation, showing a similar pair of swing rigs with the cargo engaging hooks extending downwardly thereof.

As illustrated in FIGS. 3 and 4, a reinforcing collar 64 may be supported upon the extended shank of the J-shaped tube 24, such that lugs 92 and 94 may be secured to transverse bar 90 by pins 96 and 96'. At the free end of J-shaped tube 24 there is supported a housing 76 into which the tube 24 end may be fitted by threads or the like and secured by collar 78. A pair of idler rollers 66-68 may be supported within housing 76, so as to engage simultaneously cable 34 prior to encirclement of pin 72 within cargo engaging hook 70. The free end of the cable may be secured by a press fitted compress 73, or the like, such that annular safety pad 74 may be presented adjacent hook 70. An annular bushing 84 may be positioned intermediate support plate 80 and padding bottom 82, so as to orient the safety pad assembly with respect to housing 76.

In FIGS. 3 and 4, the preferred mode of the invention is shown with a pair of swing rigs mounted in parallel with a transverse arm 90 extending therebetween. The arm 90 is secured at either end within lugs 92 and 94 by means of pins 96, 96' or the like.

Figure 5:
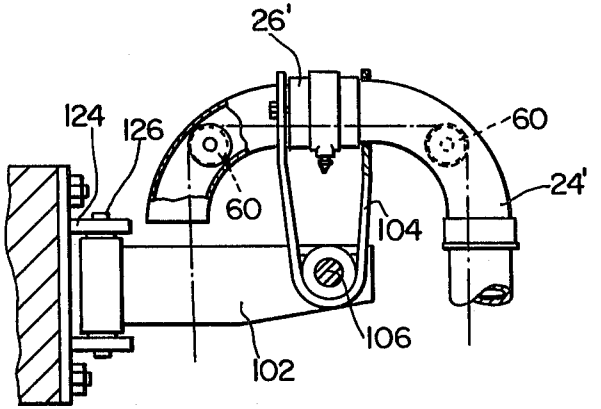
FIG. 5 is a partially fragmentary side elevation of a modified form of invention wherein a pivoted arm is used to support the inverted J-shaped swivel.
Figure 6:
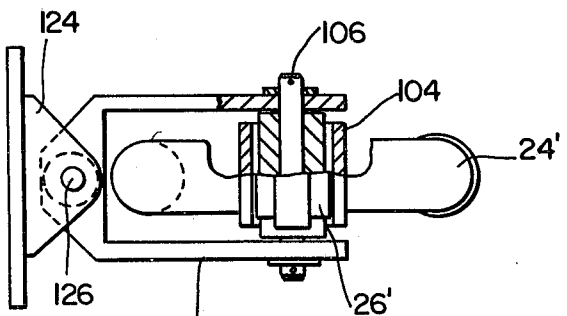
FIG. 6 is a top plan of the FIG. 5 modification.

In FIGS. 5 and 6, there is illustrated a modified form of invention wherein the inverted J-shaped tube 24' is mounted upon a vertically extending yoke 104, which, in turn, is pivoted within horizontal arm 102 by means of pin 106, or the like. Arm 102 may be pivoted within wall bracket 24 by means of pin 126, or the like. As will be apparent, the tube 24' may be pivoted readily for the cargo handling operation, illustrated in FIG. 1.

Figure 7:
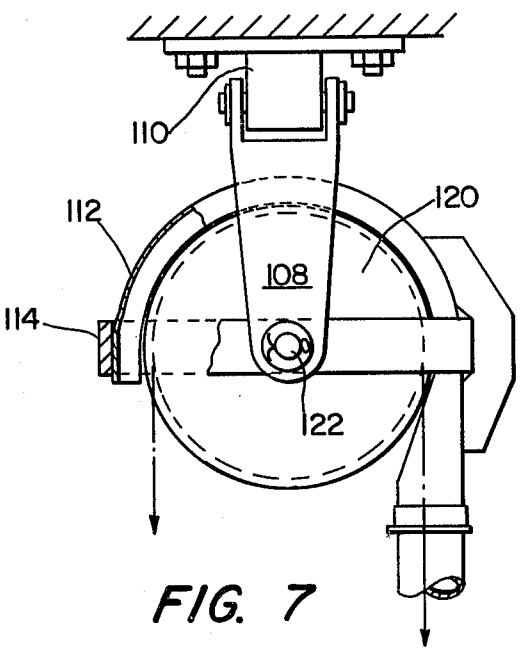
FIG. 7 is a fragmentary side elevation of a further modification wherein a single pulley is employed to support the cable and tube shank.
Figure 8:
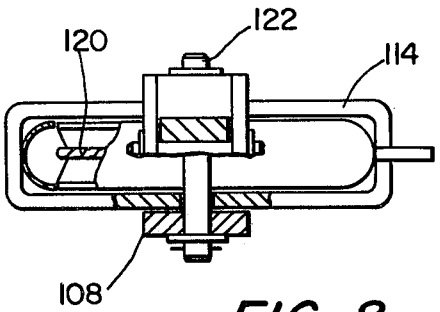
FIG. 8 is a top plan of the FIG. 7 modification.

A further modification is illustrated in FIGS. 7 and 8 wherein a single pulley 120 is rotatably mounted in downwardly extending arm 108 extending from ceiling bracket 110 and having pin 122 extending transversely through pulley 120. A rigidizing band 114 may be provided to encircle both the pulley and modified J-shaped tubing end.

OPERATION OF THE INVENTION

In the "build-up" mode the apparatus is operated by warehouse personnel at the time that a pallet has been loaded with loose cargo and moved onto a dolly or floor lift platform adjacent the inverted J-shaped tubes. The operators are required to place the cargo nets upon the warehouse floor in a neat bundle at the side of the pallet opposite the suspended booms.

The operator will then relieve the pull chain 97 from a suitable wall latch, while pulling on net hook so as to extend connecting chain 34, as the operator walks back to the pallet net 101. While pulling and walking the counter-weights 38 attached at the other end of the pull cables will travel upwardly and the inverted J-tube device will swing or pivot outwardly from the wall or stationary support pivots.

The cargo worker will now attach the securing hooks 70 to the end webbing of pallet net 101. As he releases the hooks, the counter-weights 38 will offset the weight of net 101 collected on the floor. At this point in time, the worker will be required to untangle the net as it is being hoisted and conveyed over and across the full length of the pallet.

Then, the inverted J-tube device, loaded by the weight of net 101, pivots or returns to its original position against the wall. The securing hook 76 is then released from the net by pulling down again on pull chain 97 and, thereby, permitting the operator to disengage the net hook safety latch 71.

The operation of the pair of booms, with one boom located on each side of the pallet, may be accomplished simultaneously by two workers, if a limited time factor is a requirement for netting. With the operation completed, net 101 will be placed over the cargo with each of the four sides of the webbing conventionally secured within suitable fasteners in the pallet structure.

Also, of course, previously netted pallets arriving in the warehouse for "break-down", may be un-netted using the present apparatus by reversing the operation, so as to obtain as a result, a neatly bundled net upon the warehouse floor.

Manifestly, the inverted J-shaped tube assembly may be replaced by a bell crank assembly or a pulley in combination with a vertically suspended tube, without departing from the spirit and scope of invention.

I claim:

1. A boom rack of the type adapted for handling and positioning cargo tie down equipment, comprising:

A. A base fulcrum mount;

B. A tube coupling pivoted to said base fulcrum mount upon a horizontal axis;

C. An inverted J-shaped tube secured within said tube coupling at its foreshortened end and extending upwardly, outwardly and downwardly with respect to said tube coupling; and D. A counter-weighted cable having its free end extending through said inverted J-shaped tube, so as to engage and support a cargo net hook outwardly thereof.

2. A pair of boom racks adapted for handling and positioning cargo tie down equipment as in claim 1, said boom racks being mounted in parallel such that said counter-weighted cables are extensible outwardly and downwardly so as to engage and lift a cargo tie down over cargo being secured.

3. A pair of boom racks as in claim 2, including a transverse arm secured at either end to the shank portion of each of said J-shaped tubes, such that said booms are pivotal in unison.

4. A boom rack as in claim 1, said J-shaped tube including a swivel secured in the bight of the J-shaped portion, such that the shank of the J-shaped portion is pivotal from side to side upon a horizontal axis.

5. A boom rack as in claim 4, including guide rollers positioned on either side of said swivel within the bight portion of said J-shaped tube, so as to rotatably engage said counter-weighted cable.

6. A boom rack as in claim 5, said J-shaped tube outer ends including:

i. a housing supporting a pair of guide rollers engagable with said cable free end, and ii. an annular safety pad encircling said cable.

7. A boom rack as in claim 6, said counter-weighted cable being in the form of a chain.

8. A boom rack as in claim 7, including a pull ring attached to said chain.

9. A boom rack as in claim 8, including bracket means engaging said chain, so as to secure said counter-weighted cable and inverted J-shaped tube during disuse.

10. A boom rack as in claim 1, wherein said tube coupling includes a vertical shaft pivoted in said base fulcrum mount and encircling said inverted J-shaped tube.

11. A boom rack as in claim 1, wherein said tube coupling includes a pulley rotatably mounted upon said horizontal axis, with said cable extending around said pulley and through said tube.

* * * * *